US006439195B1

(12) United States Patent
Warner

(10) Patent No.: US 6,439,195 B1
(45) Date of Patent: Aug. 27, 2002

(54) VALVE TRAIN APPARATUS

(75) Inventor: Oliver Allen Warner, Brighton, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/628,983

(22) Filed: Jul. 30, 2000

(51) Int. Cl.[7] ..... F02D 13/04

(52) U.S. Cl. ..... 123/321; 123/90.45; 123/90.46; 123/320; 123/322

(58) Field of Search ..... 123/90.15, 90.16, 123/90.17, 90.18, 90.25, 90.39, 90.44, 90.46, 90.47, 90.48, 90.55, 90.57, 320, 321, 322

(56) References Cited

U.S. PATENT DOCUMENTS 4,164,917 A * 8/1979 Glasson ..... 123/97 B
4,440,121 A * 4/1984 Clancy ..... 123/90.39
5,463,987 A * 11/1995 Cukovich ..... 123/90.15
5,626,116 A * 5/1997 Reedy ..... 123/321
5,839,453 A * 11/1998 Hu ..... 123/322
6,085,705 A * 7/2000 Vorih ..... 123/90.12
6,192,841 B1 * 2/2001 Vorih ..... 123/90.12

* cited by examiner

*Primary Examiner*—Thomas Denion
*Assistant Examiner*—Jaime Corrigan
(74) *Attorney, Agent, or Firm*—Bill C. Panagos

(57) ABSTRACT

A valve actuation device for an internal combustion engine having at least one combustion cylinder, a piston positioned within said cylinder for reciprocal motion therein; a pressurized hydraulic fluid gallery in a closed lubrication system; at least one valve in gas exchange communication for either intake or exhaust, said valve equipped with a valve spring and a seat and moveable between an open and closed position as controlled by said valve actuation device, a cam shaft with a cam for actuating said valve synchronously with said piston motion, said valve actuation device comprising: a cam configured for primary and secondary valve motion; a cam follower to transmit cam movement through a hydraulic circuit in fluid communication with said hydraulic fluid gallery into the valve between an open and closed position, and a fixed stroke accumulator selectively hydraulically controlled in said hydraulic circuit for loosing a portion of cam follower motion and to effect valve motion; an electro-hydraulic control having an on state and an off state and means for selective control of fixed stroke accumulator.

29 Claims, 5 Drawing Sheets

VALVE TRAIN APPARATUS

TECHNICAL FIELD

The present invention relates to a hydraulic lost motion apparatus for an engine valve train that achieves lashless valve operation as well as two sets of valve motion in response to signals from an engine controller in an on/off manner. Without limitation, the present invention is useful in the operation of an internal combustion engine and particularly, for example, in the operation of an exhaust valve train in a power mode and a compression brake mode.

BACKGROUND

There are instances where it is desirable to provide lashless valve operation for an internal combustion engine wherein mechanical adjustment for valve train assembly tolerance, thermal growth, wear is not necessary. Furthermore, it would be desirable to provide a valve actuation system for an internal combustion engine that combines the functions supplied by the conventional hydraulic overhead housing compression brake and the conventional mechanically lashed rocker arm assembly. Such an achievement would reduce manufacturing costs and eliminate lashing operations during manufacture and servicing of such an internal combustion engine. The means to achieve this improvement could also be applied to other engine functions such as internal EGR control, peak cylinder pressure control, airflow optimization by shifting between a low lift and a high lift profile, or even cylinder deactivation. An exhaust valve train is known wherein an integrated exhaust rocker arm assembly that includes a rocker arm having a piston and control valve, which is hydraulically controlled by a remotely mounted solenoid valve to effect a braking mode. For example, U.S. Pat. No. 5,626,116 to Reedy et al. that was granted on May 6, 1997 relates to a dedicated compression braking system for a internal combustion engine wherein an exhaust valve opens (a) near the end of an expansion stroke in a power mode of operation and (b) in a variable timed relationship to the compression stroke in brake mode. The braking system includes first and second exhaust valve actuating means for causing the exhaust valve to reciprocate in the power mode and braking mode, respectively. The first exhaust valve actuating means includes a power mode rocker lever pivotally mounted adjacent the exhaust valve for opening the exhaust valve in the power mode. A first cam means is provided to pivot the power mode rocker lever. The second exhaust valve actuating means includes a braking mode rocker lever pivotally mounted adjacent the exhaust valve for opening the exhaust valve in a braking mode. A second cam means is provided to pivot the braking mode rocker lever. The braking system of the Reedy et al. patent requires, the use of two rocker levers, one for the power mode and one for the braking mode. In addition, the apparatus described in Reedy et al. does not provide for lashless operation.

DISCLOSURE OF THE INVENTION

It is an object of the present invention to provide an improved engine valve train.

A further object of the present invention is to provide an engine valve train that effects lashless valve operation.

It is another object of the present invention to provide an engine exhaust valve train that eliminates the conventional overhead housing compression brake and thus achieve a lighter, more compact engine valve train.

Another object of the present invention is to provide an engine exhaust train that is less costly to manufacture and service.

It is also an object of the present invention to selectively achieve two sets of valve motion for either exhaust or intake valve train for desirable engine management objectives.

It is a further object of the present invention to deactivate the valve events, again for desirable engine management objectives.

BRIEF DESCRIPTION OF THE DRAWINGS

This invention may be clearly understood by reference to the attached drawings wherein like elements are designated by like reference numerals and in which.

PREFERRED EMBODIMENT FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
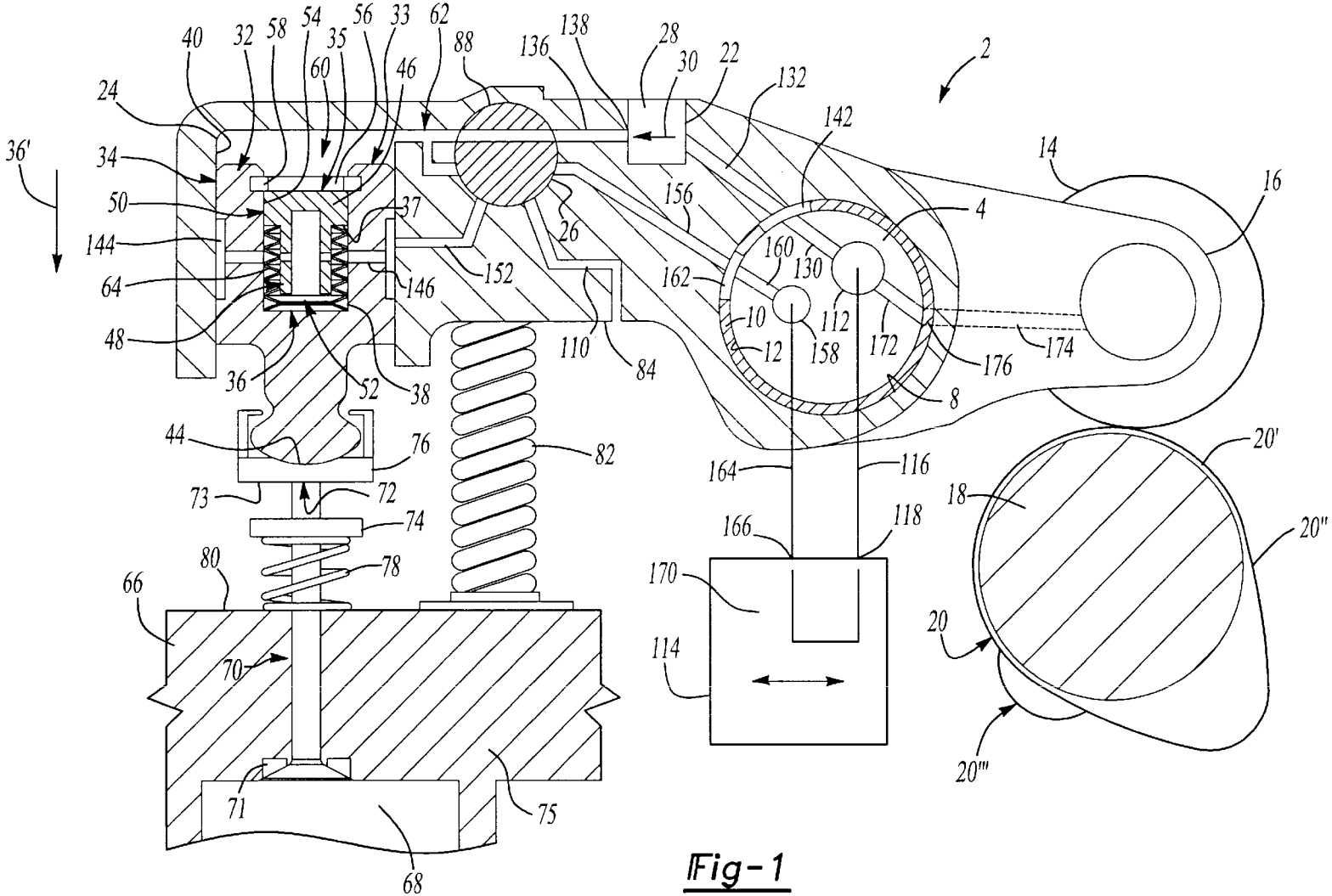
FIG. 1 is a partial cross-sectional representation of a valve actuation system illustrating the preferred embodiment of the present invention.
Figure 2:
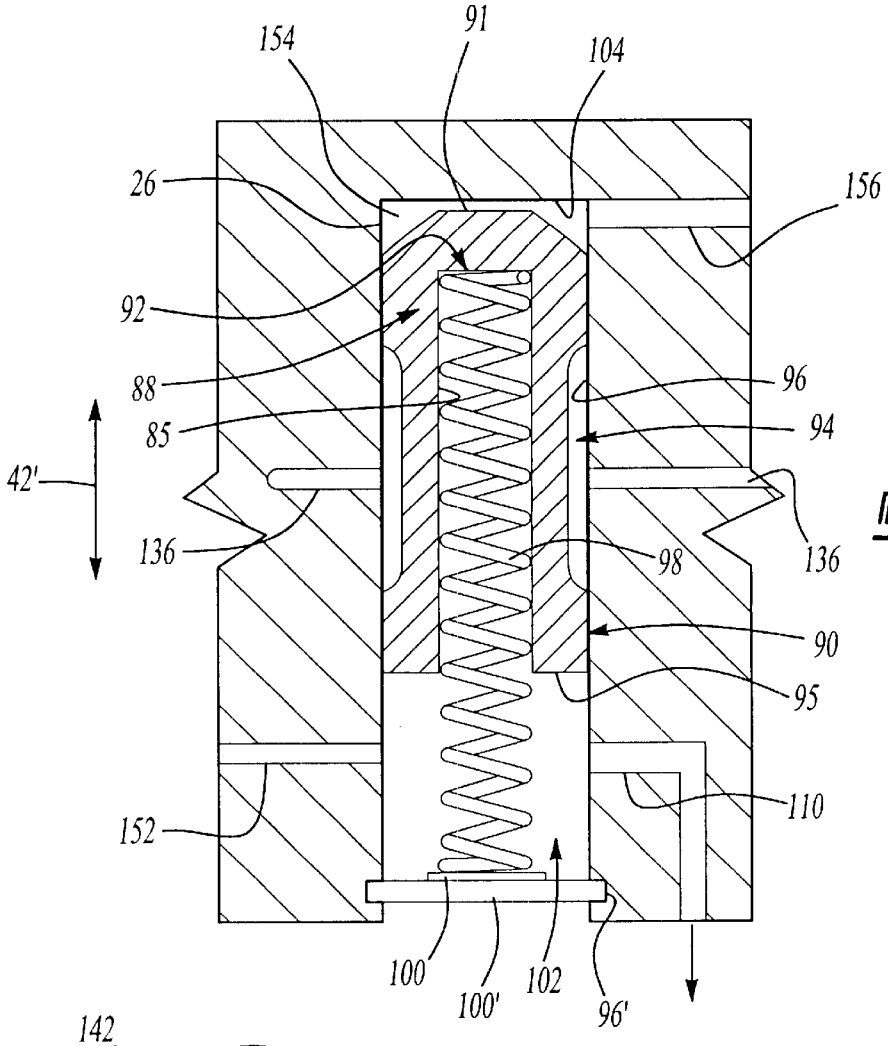
FIG. 2 is a cross-sectional representation of FIG. 1, illustrating the control valve mounted within the rocker arm of FIG. 1.

FIGS. 1 and 2 illustrate one embodiment of the present invention. Without limitation FIGS. 1 and 2 illustrate an overhead exhaust valve train for an internal combustion engine utilizing the present invention. Such engine includes at least one piston that reciprocates within an engine cylinder, and at least one exhaust valve. The exhaust valve train illustrated in FIGS. 1 and 2 achieves valve events lashlessly for normal fueled operation in power mode and for compression braking in a brake mode of operation when fuel is off as determined by an ECM. In power mode, the exhaust valve train is operated lashlessly to cause the cyclic operation of exhaust valve as usual during the operation of the internal combustion engine so as to exhaust the combusted gas from the cylinder of the engine. This is accomplished without the need for adjustment for valve train assembly tolerance, thermal growth, wear, or hydraulic leakage. In the brake mode of operation, an ECM programmed as desired and based on operator and sensor inputs enables the exhaust valve train to cause compression braking. As described hereinafter, the exhaust valve will be opened prematurely near the end of the compression stroke to expel air compressed by power absorption.

Although FIG. 1 illustrates an exhaust valve train that achieves compression brake control, the present invention is not so limited. For example, the present invention may be useful in achieving internal EGR, airflow optimization throughout the engine speed range, or peak cylinder pressure control. As a practical matter, the present invention is applicable to any strategy that involves changing between two sets of valve events in a discrete on/off manner and within the limitations of the cam profile to achieve a desirable benefit.

FIG. 1 illustrates rocker arm assembly 2 for actuating a single exhaust valve for a single cylinder of an internal combustion engine. For a cylinder with two exhaust valves, there must be either two rocker arms or a single rocker arm with a conventional bridge for simultaneous actuation of both valves. In multiple cylinder engines, a plurality of rocker arm assemblies is needed. An intake rocker arm assembly (not shown) is also needed for operation of the cylinder and it would preferably actuate its valves lashlessly. Such intake rocker arm would utilize a conventional arrangement of check valve and piston for lashless operation in the usual manner. Similar to the exhaust valve train discussed above, several configurations of intake valve train are possible depending on the particular configuration of the exhaust valve train. The intake valve operation of the embodiment illustrated in FIGS. 1 and 2 forms no part of the present invention and will not be further described herein.

FIG. 1 illustrates an exhaust rocker; arm assembly 2 that is mounted for rocking motion upon a rocker shaft 4 that is mounted to the engine head 66 in a conventional manner not shown. In particular, the rocker arm assembly 2 includes a rocker arm 6 having a cylindrical bore 8 to which a bushing 10 is pressed such that it is affixed to rocker arm 6. The rocker shaft 4 engages the inner cylindrical bore 12 of the bushing 10 to facilitate pivotal rotation while minimizing wear of the rocker arm 6 relative to the rocker shaft 4. A roller 14 is mounted to the end 16 of the rocker arm 6 in a conventional manner not shown. A cam 18 having a peripheral cam surface 20 is, mounted to the engine head by means of a camshaft in a conventional manner not shown. The roller 14 is caused to engage the peripheral cam surface 20 and to rotate and follow the peripheral cam surface, as described hereinafter, as the cam 18 rotates. In this manner the rocker arm 6 pivots relative to rocker shaft 4 as the roller 14 engages cam lobes of the cam surface 20 as described hereinafter.

The rocker arm assembly 2 includes cavities 22, 24 and 26. In the embodiment illustrated in FIGS. 1 and 2, cavities 22, 24 and 26 are cylindrical.

Check valve cavity 22 contains a high-pressure check valve 28 that is oriented such that oil may only flow through the check valve in direction 30.

Plunger cavity 24 contains a plunger 32 having a cylindrical outer surface 34, annular recess 144, annular end surface 33, spherical surface 44, and accumulator cavity 38. Outer surface 34 mates with surface 40 of cavity 24and permits plunger 32 to be slidably mounted within cavity 24 for reciprocation in direction 42.

Accumulator cavity 38 contains an accumulator 46 having a cylindrical outer surface 50, end surface 35, spring seat surface 37, and an accumulator stop 48. The outer surface 50 mates with the surface 54 of the cavity 38 and permits accumulator 46 to be slidably mounted within cavity 38 for reciprocation in direction 42. Plunger 32 and accumulator 46 form an accumulator chamber 52. One or more accumulator compression springs 64 are positioned within chamber 52. Spring 64 bears against spring seat surface 37 of accumulator 46 and end surface 36 of plunger 32 and loads surface 35 of accumulator 46 towards annular stop 56 that is fastened near the open end of cavity 38. To this end, the annular stop 56 is formed from resilient steel that permits the stop to be snapped into a circumferential groove -58 in the surface 54. Plunger chamber 60 is formed between surface 62 of cavity 24 and annular surface 33 of plunger 32 as well as surface 34 of accumulator 46. Furthermore, chamber 60 is radially bounded by cylindrical surfaces 40 of cavity 24 and 54 of cavity 38 as they are intersected by the aforementioned surfaces.

As shown in FIG. 2, the control valve cavity 26 contains a control valve 88 comprised of cylindrical outer surface 90, annular recess 94, spring stop surface 91, control valve stop'surface 95, cylindrical inner surface 85, and spring seat surface 92. The outer surface 90 mates with surface 96 of cavity 26 and permits control valve 88 to be slidably mounted within cavity 26 for reciprocation in direction 42' that is perpendicular to direction 42. Compression spring 98 bears against spring seat surface 92 of control valve 88 and a spring seat 100 and loads control valve 88 toward end surface 104 of cavity 26. Seat 100 is retained by a annular stop 100' that is snapped into groove 96' in surface 96 in a manner similar to the annular stop 56 that is snapped into groove 58. A control valve spring cavity 102 is formed between stop surface 95as well as spring seat surface 92 and spring seat 100. Furthermore, cavity 102 is radially bounded by cylindrical surfaces 96 and 85 as they are intersected by the aforementioned surfaces. Cavity 102 is continuously vented to the exterior of rocker arm 6 by means of fluid passage 110 (illustrated in FIG. 1). Control valve chamber 154 is formed between surface 104 and spring stop surface 91 and is radially bounded by surface 96 of cavity 26 as it is intersected by the aforementioned surfaces.

FIG. 1 illustrates a portion of an engine head 66 including a cylinder 68 having an exhaust valve 70 constrained to reciprocate within head 66. Valve 70 with seat 71 affixed to head 66 at entrance to exhaust port 75 effect sealing and discharge of cylinder gasses. Exhaust Valve 70 includes a valve tip surface 72 and a valve spring cap 74 affixed to valve 70. Button 76 is assembled to plunger 32 and engages spherical surface 44 such that a ball joint is formed and the button may rotate about the ball center. Button 76 has surface 73 that moves slidably on surface 72 during rocker arm 6 motion. A compression valve spring 78 is concentric with the exhaust valve 70 and bears on the valve spring cap 74 and land area 80 of the engine head 66. The spring 78 is structured and arranged to push the exhaust valve 70 against its seat 71 with a pre-load that maintains the valve in a closed position in the absence of cam displacement (illustrated in FIG. 1.)

A compression rocker arm spring 82 extends between the land area 80 and a surface 84 of the rocker arm 6. Spring 82 is structured and arranged to help push rocker arm 6 relative to the rocker shaft 4 in direction 86 so that the roller 14 remains against the cam surface 20.

The embodiment illustrated in FIGS. 1 and 2 includes three fluidic circuits comprised of a plunger circuit, an accumulator circuit, and a control circuit. The preferred hydraulic fluid used by these three circuits is pressurized engine oil that is supplied by the engines conventional lubrication system not shown. In general terms, this system consists of a pump supplied by an atmospherically ventilated sump and driven by the engine crankshaft to pressurize an oil gallery. This gallery supplies lubrication needs of the various engine components by means of fluidic passages. Leakage or other oil flows from these components return to the sump by means of gravity thus forming a closed system. Another conventional fluid with better viscosity properties could be used in a unique closed hydraulic system within the engine head 66 resulting in less fluid contamination.

For the purposes of this invention, bore 112 in shaft 4 is continuously pressurized by means of the aforementioned fluidic passages connected to the oil gallery. Bore 112 extends within the rocker shaft in the direction of the rocker shaft axis. Bore 112 also acts to supply the lubrication needs of various components such as roller 14, shaft surface 12, and bushings for camshaft that includes cam 18, etc. by conventional means not shown. The plunger circuit fluidically connects the high-pressure check valve 28 to the plunger chamber 60 and the annular recess 94 in control valve 88.

Figure 3:
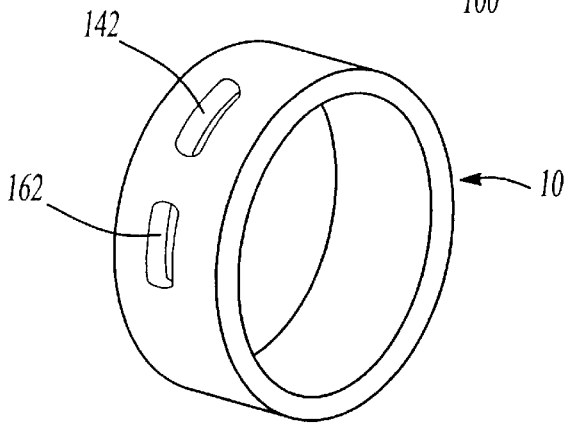
FIG. 3 is a perspective view of a bushing illustrated in FIG. 1.

The high pressure check valve 28 is continuously supplied pressurized oil by means of the following fluidically connected elements: A bore 130 that extends within the rocker shaft 4 from the bore 112 to the outer surface 12 of the rocker shaft. A bore 132 that extends within rocker arm 6 from bushing 10 to an inlet 134 o,f the check valve 28. The bushing 10 includes slot 142 that is adjacent the bores 130 and 132 to provide fluidic communication between the bores 130 and 132. FIG. 3 illustrates a bushing 10. It will be noted that slot 142 is sufficiently large so that as the rocker arm 6 pivots relative to the rocker shaft 4 including its bore 130, bores 130 and 132 will always be in fluidic communication.

The accumulator circuit fluidically connects the accumulator chamber 52 to the control valve spring cavity 102, that is always vented by means of bore 110, or to the plunger circuit through annular recess 94. In considering the accumulator circuit, the outer surface 34 of the plunger 32 is intersected by an annular recess 144. At least one bore 146, (two bores 146 are illustrated in FIG. 1) extends from the spring chamber 52 to the annular recess 144 and is structured and arranged to be in fluidic communication regardless of position of the accumulator relative to cavity 38. The accumulator circuit further includes a bore 152 extending within the rocker arm 6 from the annular recess 144 of plunger 32 to the control valve cavity 26. The bore 152 and the annular recess 144 of the plunger 32, are structured and arranged to be in fluidic communication regardless of the axial position of the plunger relative to the cavity 24. Furthermore, bore 152 intersects control valve cavity 26 such that surface 90 of control valve 88 does not cover the hole when the control valve is positioned such that control valve spring stop surface 91 is in contact with surface 104 of cavity 26. This is the power mode or off position of control valve 88 and the foregoing described accumulator circuit fluidically connects the chamber 52 to the control valve spring cavity 102 of the cavity 26 and thus ventilates chamber 52 by means of bore 110. In brake mode or on position for control valve 88, chamber 52 is connected to the plunger circuit by means of a sufficiently long annular recess 94 when surface 95 contacts the spring seat 100.

The control circuit fluidically connects the control valve chamber 154 of cavity 26, to the solenoid valve assembly 114. In considering the control circuit, a bore 156 extends within the rocker arm 6 from the control valve chamber 154 to the bushing 10. A bore 158 is provided within the rocker shaft 4. Bore 158 extends in the direction of the axis of rocker shaft 4. Another bore 160 extends within the rocker shaft 4 between the bore 158 and the outer surface 12 of the rocker shaft. The bushing 10 includes a slot 162 that is adjacent the bores 156 and 160 to provide fluidic communication between the bores 156 and 160. With reference to FIG. 3, it will be noted that opening 162 is sufficiently large so that as the rocker arm 6 pivots relative to the rocker shaft 4, including its bore 160, bores 156 and 160 will always be in fluidic communication. Bore 158 is illustrated schematically as being in fluid communication with flow passage 164 that extends from the bore 158 to an inlet/outlet port 166 of the solenoid valve assembly 114.

Solenoid valve assembly 114 is a conventional two-way solenoid valve whose operating principle is simplistically illustrated in FIG. 1 and is mounted by means of adapter hardware so that the necessary fluidic circuits are established. The solenoid valve assembly has an inlet/outlet port 166 mentioned previously as well as a supply port 118 and a vent port 170 to the assembly exterior. Supply port 118 is fluidically connected to bore 112 in shaft 4 by means of passage 116 and this provides a continuous supply of pressurized oil to the solenoid valve assembly 114. When the solenoid valve assembly is de-energized or in its off state as in power mode, inlet/outlet port 166 is fluidically connected with the vent port 170 and supply port 118 is blocked. This results in ventilation of the control circuit (comprised of control valve chamber 154 and passages. 156, 162, 160, 164) as long as this state exists. Since there is little or no pressure in chamber 154, the control valve spring 98 moves the control valve 88 to be in its off position and this ventilates the accumulator circuit as described. previously. When the solenoid valve assembly is energized or in its off state as in brake mode, inlet/outlet port 166 is fluidically connected to supply port 118 and vent port 170 is blocked. This results in pressurization to supply pressure of the control circuit as long as this state exists. This causes the control valve spring 98 to be overcome and the control valve 88 to move to its on position and this fluidically connects the plunger circuit to the accumulator circuit by means of annular recess 94 It should be noted that the present invention is not limited to the foregoing apparatus. For example, rather than being disposed within a rocker arm assembly, the mechanism can be part of a master-slave piston arrangement. The only requirement is that whatever arrangement is used, it must be part of the force transmitted between the cam input and the valve output, and that motion is lost or not by control of the accumulator stroke.

Figure 4:
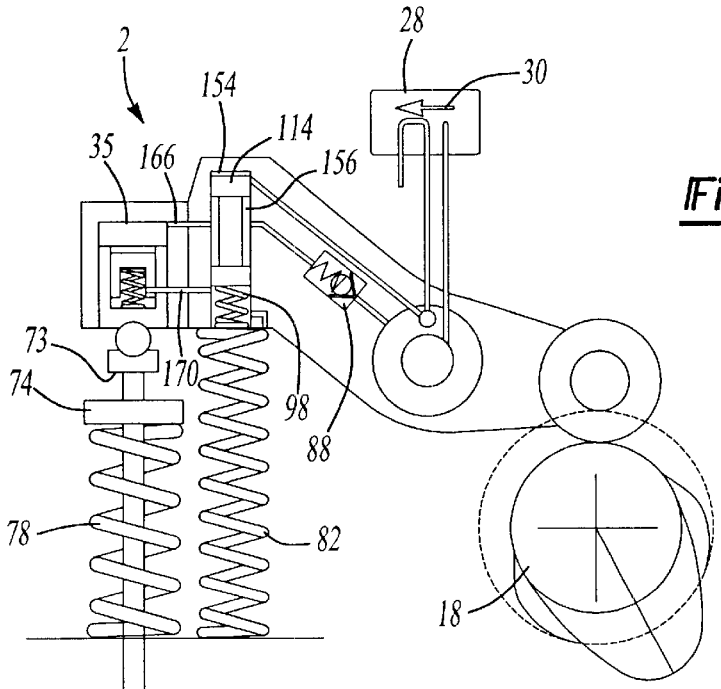
FIGS. 4 and 5 schematically illustrate the embodiment of FIGS. 1 and 2 in a power mode.
Figure 5:
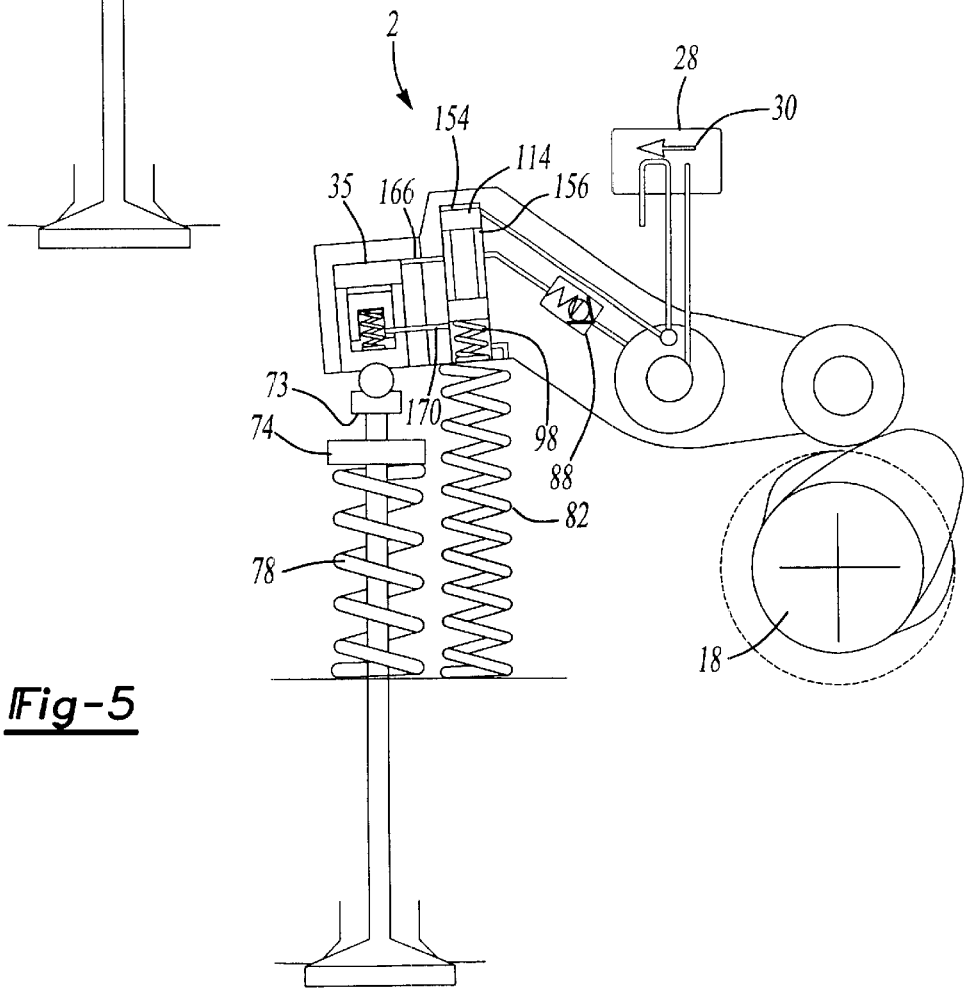
Figure 6:
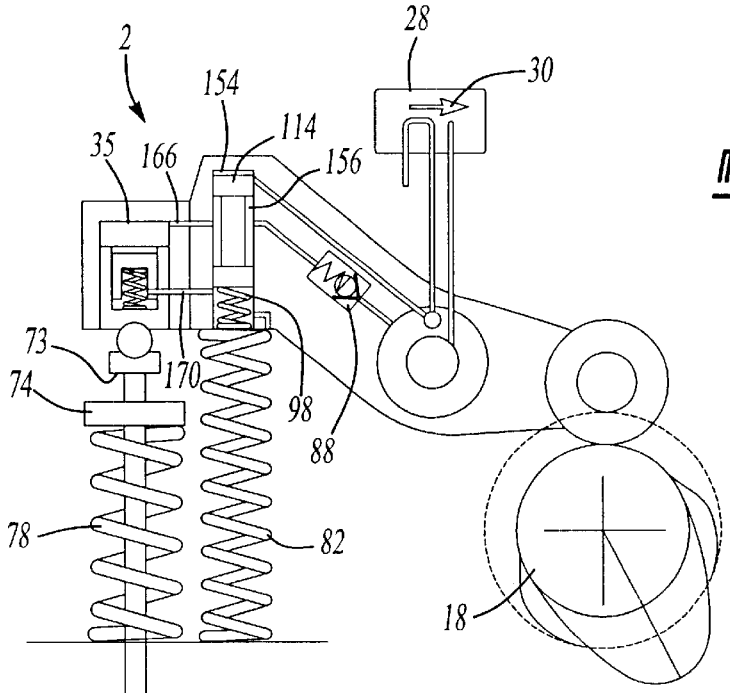
FIGS. 6 and 7 schematically illustrate the embodiment of FIGS. 1 and 2 in a brake mode.
Figure 7:
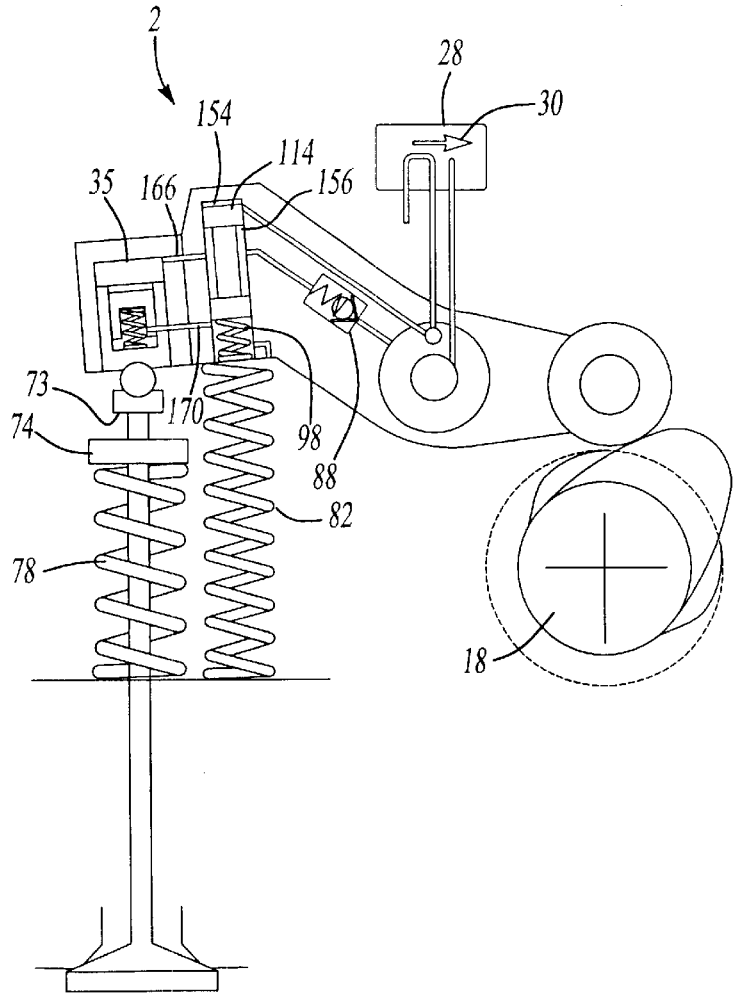

Operation of the engine exhaust valve train illustrated in FIGS. 1 to 3 will now be described with reference to FIGS. 1, 2 and 4 to 7. FIGS. 4 and 5 schematically illustrate the embodiment of FIGS. 1 to 3 in a power mode of operation and FIGS. 6 and 7 schematically illustrate the embodiment of FIGS. 1 to 3 in a brake mode of operation.

POWER MODE

Referring to FIGS. 1, 2, 4 and 5, a conventional ECM is provided (not shown) that is programmed to send signals to and thereby energize or de-energize the solenoid valve assembly 114 as desired. Regardless of whether the solenoid valve assembly 114 is energized or de-energized, bore 112 will equal the oil pressure of the oil flowing from the engines oil pump (not shown).

In the power mode, with reference to FIGS. 1, 2 and 4, the solenoid valve assembly 114 is de-energized to provide fluidic communication between ports 166 and 170. As a result oil in the control valve chamber 154 is vented through bore 156, slot 162, bore 160, bore 158, and flow passage 164, and ports 166 and 170. As the chamber 154 is vented, the spring 98 loads the control valve 88 towards surface 104. of the control valve cavity 26. The control valve 88 encounters no resistance from vented chamber 154 vented spring cavity 102, or pressure balanced annular recess 94. Control valve 88 moves until stop surface 91 contacts and is stopped by surface 104. This provides fluidic communication between bore 152 and flow passage 110 through spring chamber 102. As a result, oil in the accumulator cavity 52 is vented by means of bores 146, 152 and 110 and annular recess 144.

In this de-energized, or off state, as the roller 16 engages base circle 20' of cam surface 20 on rotating cam 18, there is no rocker motion of the rocker arm 6. During. such period a small quantity of oil equal to leakage from the previous cycle flows from pressurized bore 112 into the plunger chamber 60 through the high-pressure check valve 28. In this manner, the plunger chamber 60 is refilled and the pressurized oil therein displacing plunger 32 and its attached button 76. This occurs until surface 73 of button 76 comes in contact with and is stopped by surface 72 of exhaust valve 70. Since the valve 70 is preloaded by the valve spring 78 as it acts through the valve on the valve seat, the diameter of the plunger 32 must be such that its force is significantly less than the valve spring pre-load so as not to move the valve. This contact between plunger 32 and valve 70 eliminates effects of valve train tolerance, thermal growth, or wear. As a result, it is possible to achieve a minimum condition in order for subsequent lashless valve operation to occur. Pressurization of plunger chamber 60 up to the engine oil supply pressure dictates the pre-load. force of the accumulator spring 64 since the accumulator 46 is retained in the plunger 32. In particular, the pre-load force of the spring 64 may not be overcome by the engine oil supply pressure and is sufficient to hold the accumulator 46 against the retainer 56 during the period when the roller 16 engages the base circle 20' of the cam surface 20.

With reference to FIGS. 1, 2 and 5, near the end of the compression stroke, continued rotation of the cam 18 causes the roller 14 to engage the brake lobe 20" of cam surface 20. As roller 14 moves up brake lobe 20", the rocker arm 6 rotates in direction 86' about the rocker shaft 4. The plunger 32 is constrained not to open the exhaust valve 70 as a result of the pre-load of spring 78 and the pressure within cylinder 68 acting on the sealed valve. This causes pressure to exceed supply oil pressure since oil cannot escape through check valve 28 in the plunger chamber 60 as the rocker arm 6 moves in direction 86' down about the stationary plunger 32. As rocker arm 6 moves in direction 86', this oil pressure buildup in plunger chamber 60 will overcome the pre-load force of accumulator spring 64 since there is no additional resistance from the ventilated accumulator chamber 52. From this point on, accumulator spring,load will dictate pressure in chamber 60 as rocker arm 6 rotation progresses. Further rotation in direction 86' of the rocker arm 6 by the brake lobe 20" will cause the accumulator 46 to move further down inside of the stationary plunger 32 until accumulator stop surface 48 contacts and is stopped by surface 36 of plunger 32. From this point on, valve loads will dictate pressure in chamber 60 as rocker arm 6 continues to rotate (illustrated by FIG. 5). The engine exhaust valve 70 does not move until the accumulator 46 reaches the end of its downward stroke and thus the cam motion associated with surface 20" was lost. The volume of trapped oil in the plunger circuit being essentially constant leads to the necessary relationship between plunger stroke that is also motion lost at the valve, the accumulator stroke, and the diameters of surface 50 for accumulator 46 and surface 34 for plunger 32. The relationship is plunger stroke. must equal the ratio of the accumulator diameter squared to the plunger diameter squared times the accumulator stroke. Further rotation in direction 86' of the rocker arm 6 by the exhaust lobe 20'" will result in valve motion since plunger 32 can no longer move relative to rocker arm 6 since accumulator 46 is bottomed out in the plunger. The high-pressure check valve 28 continues to seal the plunger circuit, preventing flow of oil in a direction opposite to the direction 30. In other words, the oil pressure in chamber 60 will be greater than the pre-load force of valve spring 78 and the pressure within cylinder 68. This opens the exhaust valve 70 with the desired exhaust lift profile. Upon closure of the exhaust valve 70, valve seating velocity will be controlled by the cam surface 20'" as pressure in chamber 60 transfers the spring load of spring 78 on exhaust valve 70. During reset to the base circle 20' by means of 20"" of the cam surface 20, the roller 14 will be loaded against surface 20"" by the load of accumulator spring 64 as it reacts on the now stationary plunger 32. Plunger 32 is being held stationary by the pre-load of spring 78 on closed valve 70. Rocker spring 82 also helps load roller 14 on surface 20"" by means of rocker arm 6 in direction 86.

BRAKE MODE

Lashless compression brake operation of this invention as shown by FIGS. 1 to 3 will now be explained with reference to FIGS. 1, 2, 6 and 7. Referring to FIGS. 1, 2 and 6, in the brake mode, the solenoid valve assembly 114 is energized by signals from the ECM to provide fluidic communication between ports 118 and 166. As a result, control valve chamber 154 is pressurized by means fluidic communication of bore 156; slot 162, bore 160, bore 158, passage 164, port. 166, port 118, passage 116, and bore 112. Thus, pressurized oil flows into control valve chamber 154 displaces the piston 88 towards spring seat 100 by overcoming spring 98 and because spring cavity 102 is vented and annular recess 94 is pressure balanced thus offering no additional resistances. This occurs until control valve stop surface 95 contacts and is stopped by spring seat 100. This results in annular cavity 94 aligning with bore 136 and bore 152 so that are in fluidic communication occurs. While rocker arm 6 is on base circle surface 20', pressurized oil flows into the plunger circuit through high pressure check valve 28 and by means of bore 136 into plunger cavity 60 and through annular recess 94 into the accumulator circuit Thus accumulator chamber 52will be filled by pressurized oil flowing through bore .152, annular recess 144, bore 146. As noted above, pressurized oil in the plunger chamber 60 effects lashless engagement with valve 70. With reference to FIGS. 1, 2 and 6, continued rotation of the cam 4 causes the roller 14 to engage the brake lobe 20" of the cam surface 20. As the roller 14 begins moving up the brake lobe 2', the rocker arm 6 rotates about the rocker shaft 4 in direction 86'. Accumulator 46 is against its retainer 56 because of its spring 64 and is immovable because pressure in its chamber 52 is always equal to pressure in plunger chamber 60 due to the fluidic connection between these chambers effected by the position of control valve 88. With the accumulator effectively locked and therefore incapable of absorbing or loosing motion, rotation of the rocker arm 6 in direction 86' by the brake lobe 20" causes pressure in plunger chamber 60 and accumulator chamber 52 to rise. Plunger 32 causes button 76 to bear down upon surface 72 of the valve 70 with sufficient force to force open the valve at a time when gas loads on the valve are, the significant load. This occurs at the same location near the end of the compression stroke for cylinder 68 where valve motion was lost in power mode. Plunger 32 being essentially locked in rocker arm 6 causes valve 70 motion proportional to rotation of the rocker arm as roller 14 moves over surfaces 20", 20'", 20"" as cam 18 rotates. Valve seating is controlled by 20"" by the same method described for power mode above.

One consequence of utilizing a lost motion cam by the method of this invention is the occurrence of over lift. After maximum brake lift is achieved at the end of surface 20" (as illustrated in FIG. 7), further valve lift associated with 20'" will cause lift equal to the power mode lift plus the previous maximum brake lift. Over lift can be eliminated by orienting the axis of control valve 88 to be coincident with direction 42 and providing a small spring reacting on deck 80 by means of a pedestal that is concentric with spring 82. This spring would bear upon spring seat 100 and provide sufficient load near the beginning of lift associated with cam surface 20''' such that control valve 88 moves towards end 104. The spring will be structured and arranged such that surface 91 of control valve 88 will contact and be stopped by surface 104 of cavity 26 prior surface 20''' reaching maximum lift minus brake maximum lift. Thus the control valve will be in its power mode position and accumulator chamber 52 will be ventilated by means described above.

Figure 8:
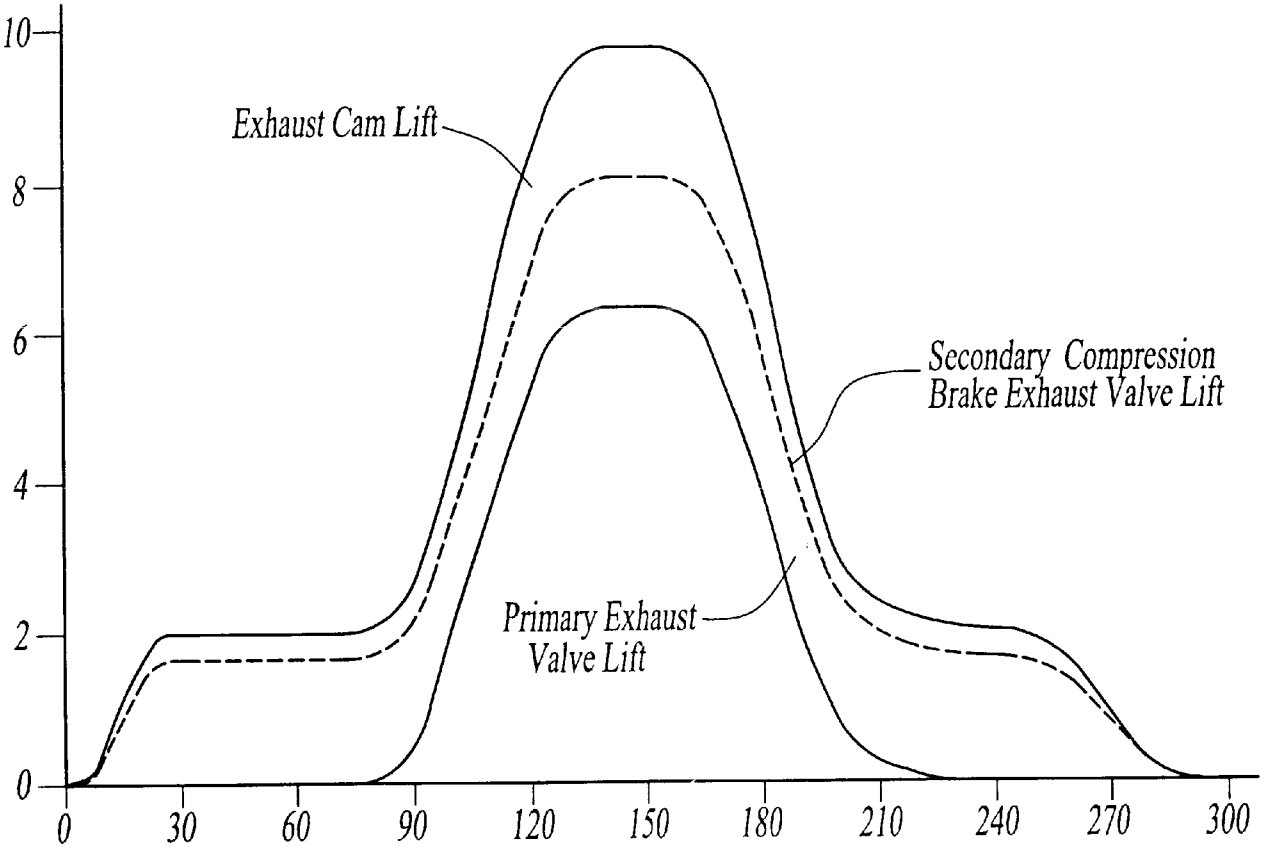
FIG. 8 is a view of other possible cam lift curves controllable by this invention.

FIG. 8 is a view of other possible cam lift curves controllable by this invention. As can be clearly seen in FIG. 8, when the primary valve motion is of short duration and low lift, the secondary valve motion is of long duration and high lift as compared to said primary valve motion. Moreover, it can be seen that the valve motion is achieved as a single event, or as multiple events. Finally, it can be seen that a valve deactivation state is the primary valve motion and normal valve motion is the secondary valve motion.

The embodiments that have been described herein are but some of several which utilize this invention and are set forth here by way of illustration but not of limitation. It is apparent that many other embodiments that will be readily apparent to those skilled in the art may be made without departing materially from the spirit and scope of this invention.

I claim:

1. A valve actuation device for an internal combustion engine having at least one combustion cylinder, a piston positioned within said cylinder for reciprocal motion therein; a pressurized hydraulic fluid gallery in a closed lubrication system; at least one valve in gas exchange communication for either intake or exhaust, said valve equipped with a valve spring and a seat and moveable between an open and closed position as controlled by said valve actuation device, a cam shaft with a cam for actuating said valve synchronously with said piston motion, said valve actuation device comprising:

(a) a cam configured for primary and secondary valve motion;

(b) a cam follower to transmit cam movement through a hydraulic circuit in fluid communication with said hydraulic fluid gallery into the valve between an open and closed position;

(c) a fixed stroke accumulator selectively hydraulically controlled in said hydraulic circuit for loosing a portion of cam follower motion and to effect valve motion;

(d) an electro-hydraulic control comprised of at least one solenoid valve assembly in fluidic communication with a control circuit; said solenoid valve assembly controlled by said ECM and having an on state and an off state means for selective control of fixed stroke accumulator;

(e) said valve actuation device comprised of a rocker arm rockably mounted on a rocker shaft; said arm equipped with said cam follower at one end; said hydraulic circuit integral with said arm said hydraulic circuit comprised of a plunger circuit, a control circuit and an accumulator circuit; said control circuit equipped with a fluidic passage integral to said rocker arm and between said rocker shaft to said control valve; said control valve comprised of a cylindrical valve control cavity and a control valve within said cavity for reciprocal movement therein through a fixed stroke; said control valve at one end forming a chamber with said cavity and fluidically connected to said control circuit; said control valve retained within said valve cavity at a second end by a retainer affixed to said rocker arm and acted upon by biasing means in a biasing means cavity at said second end of said valve cavity; said biasing cavity equipped with a fluidic passage to said rocker exterior for continuous ventilation.

2. The valve actuation device of claim 1, wherein the cam is equipped with a primary lobe and at least one other lobe.

3. The valve actuation device of claim 1, wherein primary valve motion causes power mode operation of said cylinder, and cessation of fuel delivery and enabling said electro-hydraulic control means causes said secondary valve motion and operation of said cylinder in compression brake mode.

4. The valve actuation device of claim 1, wherein said primary valve motion is of short duration and low lift, and said secondary valve motion is of long duration and high lift as compared to said primary valve motion.

5. The valve actuation device of claim 4, wherein said valve motion is achieved as a single event.

6. The valve actuation device of claim 4, wherein said valve motion is achieved as multiple events.

7. The device of claim 1, wherein said rocker shaft is equipped with at least one fluidic passage for continuous supply of fluid from said gallery to a solenoid valve and said plunger circuit; said rocker shaft further equipped with at least one fluidic passage for intermittent supply of fluid from said solenoid valve to said control circuit.

8. The valve actuation device of claim 1, wherein said control circuit terminates at a control valve chamber integral in at least one rocker arm.

9. The valve actuation device of claim 8, wherein said ECM produces a signal that energizes said solenoid valve assembly to cause secondary valve motion and no signal from the ECM causes primary valve motion.

10. The valve actuation device of claim 9, wherein said signal is enabled based upon operator input, sensor input or internal logic in the ECM.

11. The valve actuation devices of claim 10, wherein said solenoid valve assembly is a two-way solenoid valve equipped with fluidic passages in fluidic communication with said rocker shaft fluid passages and a fluidic passage for ventilation of fluid to said solenoid valve assembly exterior.

12. The valve actuation device of claim 11, wherein said solenoid valve in its off state fluidically connects said control circuit to said ventilation passage and blocks connection with said gallery, and said. solenoid valve in its on state, fluidically connects said control circuit with said gallery while blocking connection with said ventilation passage.

13. The valve actuation device of claim 1, wherein when said control valve chamber is pressurized with fluid in the on state, said pressure overcomes said biasing means load and displaces said control valve until said control valve is stopped by said control valve retainer.

14. The valve actuation device of claim 13, wherein said plunger circuit is comprised of a fluidic passage extending from a check valve to said control valve annulus, and terminating at a plunger chamber, said check valve continuously supplied with fluid flow through a fluidic passage from said rocker shaft passage.

15. The valve actuation device of claim 14, wherein said plunger chamber is comprised of a cylindrical plunger cavity and a plunger for reciprocal motion therein.

16. The valve actuation device of claim 15, wherein said plunger is comprised of a means for valve engagement, an external annulus, a cylindrical inner accumulator cavity having an accumulator deposed for reciprocal movement through a fixed stroke therein; said accumulator retained in said cavity by an accumulator retainer affixed to said plunger; said accumulator acted on by a biasing means within said accumulator cavity.

17. The valve actuation device of claim 16, wherein said check valve controls fluid flow into and out of said plunger circuit.

18. The valve actuation device of claim 17, wherein said fluid pressure causes said plunger to remove lash between said plunger valve engagement means and said valve without moving the valve from its closed position.

19. The valve actuation device of claim 18, wherein the accumulator stroke is determined by valve lost motion distance multiplied by the square of the plunger diameter divided by the square of the accumulator diameter.

20. The valve actuation device of claim 19, wherein said accumulator circuit is comprised of a fluidic passage from said accumulator passage to said plunger annulus, and terminating in said control valve cavity, whereby said accumulator chamber is fluidically connected to said control valve cavity throughout said accumulator stroke and said plunger stroke.

21. The valve actuation device of claim 20, wherein said fluidic passage from said accumulator passage to said control valve intersects said control valve cavity such that when the control valve is in its off state, said accumulator circuit is fluidically ventilated by connection to said control biasing means cavity.

22. The valve actuation device of claim 21, wherein during cam lobe occurrence, fluid ventilation allows said accumulator motion as said plunger circuit pressure on one side of the accumulator overcomes the biasing means load on a second side of said accumulator resulting in cam motion being lost; until such time as said accumulator reaches the end of its stroke resulting in transmission of cam motion to said valve.

23. The valve actuation device of claim 22, wherein when said control valve is in an. on state, said accumulator circuit is fluidically connected to said plunger circuit by means of said control valve annulus; and elimination of said ventilation results in fluid filling of the accumulator circuit; and upon occurrence of said cam lobes, said fluidic pressure is equalized across said accumulator thereby rendering said accumulator unmovable resulting in transmission of all cam lobe motion.

24. The valve actuation device of claim 1, wherein said accumulator is integral with said rocker arm and in fluidic communication with said plunger circuit.

25. The valve actuation device of claim 1, wherein said valve motion is achieved lashlessly.

26. The valve actuation device of claim 1, wherein lash is introduced when said hydraulic circuit is insufficiently filled, and said plunger circuit is unable to create pressure, thereby causing lower lift, and lower primary valve motion.

27. The valve actuation of claim 1, wherein said device is applied to only the exhaust valve.

28. The valve actuation device of claim 1, wherein said device is applied only to the intake valve.

29. The valve actuation device of claim 1, wherein when the electro-hydraulic control means is in the on state, there is no primary valve motion, and only secondary valve motion occurs.

* * * * *